US008112826B2

(12) United States Patent
Kang et al.

(10) Patent No.: US 8,112,826 B2
(45) Date of Patent: Feb. 14, 2012

(54) APPARATUS AND METHOD FOR CONTROLLING OPENING AND CLOSING UNIT BY USING COUNTER ELECTROMOTIVE FORCE OF MOTOR

(75) Inventors: Tae-Kyung Kang, Seoul (KR); Man-Ho Byean, Suwon (KR); Ju-Hyun Baek, Seoul (KR)

(73) Assignee: Woongjin Coway Co., Ltd., Gongjoo (KR)

( * ) Notice: Subject to any disclaimer, the term of this patent is extended or adjusted under 35 U.S.C. 154(b) by 428 days.

(21) Appl. No.: 12/518,421

(22) PCT Filed: Mar. 31, 2009

(86) PCT No.: PCT/KR2009/001653

§ 371 (c)(1),
(2), (4) Date: Jun. 9, 2009

(87) PCT Pub. No.: WO2009/131314

PCT Pub. Date: Oct. 29, 2009

(65) Prior Publication Data

US 2010/0313343 A1 Dec. 16, 2010

(30) Foreign Application Priority Data

Apr. 23, 2008 (KR) ..... 10-2008-0037753
Mar. 31, 2009 (KR) ..... 10-2009-0027396

(51) Int. Cl.
*A47K 13/00* (2006.01)

(52) U.S. Cl. ..... 4/246.1

(58) Field of Classification Search ..... 4/246.1–246.5
See application file for complete search history.

(56) References Cited

U.S. PATENT DOCUMENTS 6,067,667 A * 5/2000 Suzuki ..... 4/246.1
6,775,854 B2 * 8/2004 Nishikawa et al. ..... 4/246.1
7,788,741 B2 * 9/2010 Lohss ..... 4/246.1

FOREIGN PATENT DOCUMENTS

| | | |
|---|---|---|
| JP | 10-9317 | 1/1998 |
| JP | 11-76103 | 3/1999 |
| JP | 2004-525 | 1/2004 |
| JP | 2004-344254 | 12/2004 |
| KR | 2002-0024009 | 3/2002 |
| KR | 10-0642347 | 11/2006 |

* cited by examiner

*Primary Examiner* — Huyen Le
(74) *Attorney, Agent, or Firm* — McDermott Will & Emery LLP

(57) ABSTRACT

An apparatus for controlling a rotational movement of an opening and closing unit by using a counter electromotive force of a motor includes: a motor driving unit that drives an electric damper by driving a motor to operate the opening and closing unit; a position detecting unit that detects the position of the opening and closing unit operated by the motor driving unit; a power intercepting unit that receives a signal of detecting the position of the opening and closing unit from the position detecting unit, and cuts off power if it determines that the opening and closing unit is at a pre-set position based on the received position detect signal; and a counter electromotive force generating unit that generates a counter electromotive force of the motor when the power intercepting unit cuts off power.

8 Claims, 4 Drawing Sheets

APPARATUS AND METHOD FOR CONTROLLING OPENING AND CLOSING UNIT BY USING COUNTER ELECTROMOTIVE FORCE OF MOTOR

TECHNICAL FIELD

The present invention relates to an apparatus and method for controlling an opening and closing unit using a counter electromotive force of a motor, and more particularly, to an apparatus and method for controlling an opening and closing unit by generating a counter electromotive force of a motor when the opening and closing unit that makes a rotational movement (i.e., a reciprocal turning operation) is closed.

BACKGROUND ART

A bedpan seat (i.e., stool seat) or a bedpan seat cover provided at a general toilet stool (i.e., toilet bowl) will be described as an example of an opening and closing unit that makes a rotatable (or tuning) movement with reference to FIG. 1.

FIG. 1 is a perspective view of the related art toilet stool including a hot water washer (i.e., hot water cleaner). As shown in FIG. 1, the toilet stool including a hot water washer includes a toilet pot 10 disposed at a central portion thereof and an injection nozzle 30 disposed at a rear portion of the toilet pot 10 such that it moves in and out to traverse the toilet pot 10 and jetting washing water. A bedpan seat 20 is placed on the toilet pot 10, and a bedpan seat cover 40 is connected to the bedpan seat 20 to cover the bedpan seat 20 after stool.

A manipulation display unit 60 including manipulation keys to perform an operation manipulation of the hot water washer and displaying an operational state of the hot water washer is disposed at one side of the toilet stool. A machining chamber (i.e., electrical component chamber) 50 including various electrical parts and mechanical parts constituting a washing water storage and injection mechanism, a washing water heating mechanism, and a hot wind generating mechanism is provided at a rear side of the toilet stool.

First and second gear boxes (not shown) are coupled to the bedpan seat 20 and the bedpan seat cover 40 to automatically open and close the bedpan seat 20 and the bedpan seat cover 40.

In this manner, in the related art, the opening and closing operation of the bedpan seat 20 and the bedpan seat cover 40 is controlled by using the gear boxes, a spring, or a semiconductor integrated circuit.

However, when the bedpan seat 20 or the bedpan seat cover 40 is closed after stool, it is rapidly lowered to collide with the toilet pot 10, generating an impact sound. The impact sound frightens old or feeble persons, children, pregnant women and nursing mothers, and so on, and also, those bedpan seat 20 and the bedpan seat cover 40 are not suitable for a place where quite atmosphere needs to be maintained.

DISCLOSURE

Technical Problem

An aspect of the present invention provides an apparatus and method for reducing an impact sound generated when an opening and closing unit that makes a reciprocal rotational movement collides, by preventing the opening and closing unit from being rapidly lowered although a power supply is cut off.

Technical Solution

According to an aspect of the present invention, there is provided an apparatus for controlling a rotational movement of an opening and closing unit by using a counter electromotive force of a motor, including: a motor driving unit that drives an electric damper by driving a motor to operate the opening and closing unit; a position detecting unit that detects the position of the opening and closing unit operated by the motor driving unit; a power intercepting unit that receives a signal of detecting the position of the opening and closing unit from the position detecting unit, and cuts off power if it determines that the opening and closing unit is at a pre-set position based on the received position detect signal; and a counter electromotive force generating unit that generates a counter electromotive force of the motor when the power intercepting unit cuts off power.

The opening and closing unit may include a bedpan seat or a bedpan seat cover provided at a toilet stool.

The apparatus for controlling a rotational movement of an opening and closing unit may further include: an initialization unit that recognizes the position of the bedpan seat or the bedpan seat cover as an initial state upon receiving a stop signal from the position detecting unit, when the bedpan seat or the bedpan seat cover in a closed state is open and then stopped at a pre-set angle or larger.

The position detecting unit may detect the position of the bedpan seat or the bedpan seat cover by counting time during which the bedpan seat or the bedpan seat cover has operated from its initial state.

The position detecting unit may detect the position of the bedpan seat or the bedpan seat cover by counting the number of pulse signals outputted from the motor driving unit from a point when the bedpan seat or the bedpan seat cover starts to operate at the initial state.

When the power intercepting unit cuts off power, the pre-set position of the bedpan seat or the bedpan seat cover may be a position at one of angles ranging from 40° to 50° after the bedpan seat or the bedpan seat cover is open and then stopped at the pre-set angle or larger from its closed state.

According to another aspect of the present invention, there is provided a method for controlling a rotational movement of an opening and closing unit by using a counter electromotive force of a motor, including: driving, by a motor driving unit, an electric damper by driving a motor to operate the opening and closing unit; detecting, by a position detecting unit, the position of the opening and closing unit operated by the motor driving unit; receiving, by a power intercepting unit, a signal of detecting the position of the opening and closing unit from the position detecting unit, and cutting off power if it determines that the opening and closing unit is placed at a pre-set position based on the received position detect signal; and generating, by a counter electromotive force generating unit, a counter electromotive force of the motor when the power intercepting unit cuts off power.

The method for controlling a rotational movement of an opening and closing unit may further include: recognizing, by an initialization unit, the position of the bedpan seat or the bedpan seat cover as the opening and closing unit provided at the toilet stool, as an initial state upon receiving a stop signal from the position detecting unit, when the bedpan seat or the bedpan seat cover in a closed state is open and then stopped at a pre-set angle or larger.

Advantageous Effects

As set forth above, according to exemplary embodiments of the invention, when the opening and closing unit that makes the reciprocal movement is closed, the counter electromotive force of the motor is generated to prevent the opening and closing unit from being rapidly lowered although power supply is cut off. For example, if the opening and closing unit is the bedpan seat or the bedpan seat cover provided at the toilet stool, an impact sound generated when the bedpan seat or the bedpan seat cover collides with the toilet pot can be reduced. Thus, old or feeble persons, children, pregnant women and nursing mothers, and so on, would not be frightened by the impact sound, and the opening and closing unit (i.e., the bedpan seat and the bedpan seat cover) can be favorably used in a place where quite atmosphere needs to be maintained.

DESCRIPTION OF DRAWINGS

The above and other aspects, features and other advantages of the present invention will be more clearly understood from the following detailed description taken in conjunction with the accompanying drawings, in which.

MAJOR REFERENCE NUMERALS/SYMBOLS OF THE DRAWINGS

Figure 1:
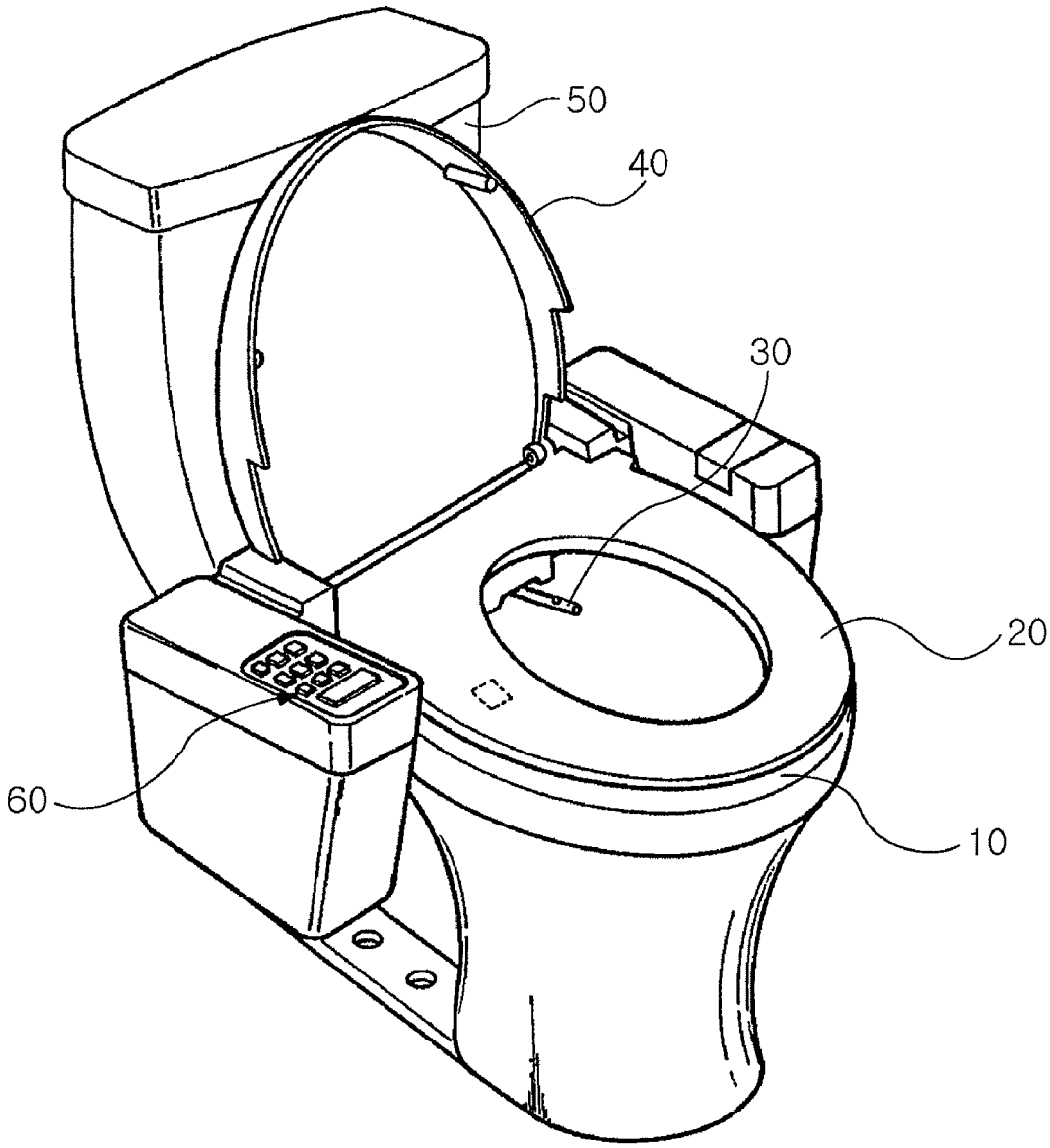
PRIOR ART FIG. 1
FIG. 1 is a perspective view of the related art toilet stool including a hot water washer.

100: initialization unit
200: motor driving unit
300: position detecting unit
400: power intercepting unit
500: counter electromotive force generating unit
600: motor
700*a*, 700*b*, 700*c*, 700*d*, 700*e*, 700*f*: bedpan seat

BEST MODE

Exemplary embodiments of the present invention will now be described in detail with reference to the accompanying drawings. The invention may however be embodied in many different forms and should not be construed as limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

The present invention relates to an apparatus and method for controlling a rotational movement of an opening and closing unit. Specifically, an apparatus and method for controlling a bedpan seat or a bedpan seat cover provided at a toilet stool according to exemplary embodiments of the present invention will now be described with reference to FIGS. 2 to 5.

Figure 2:
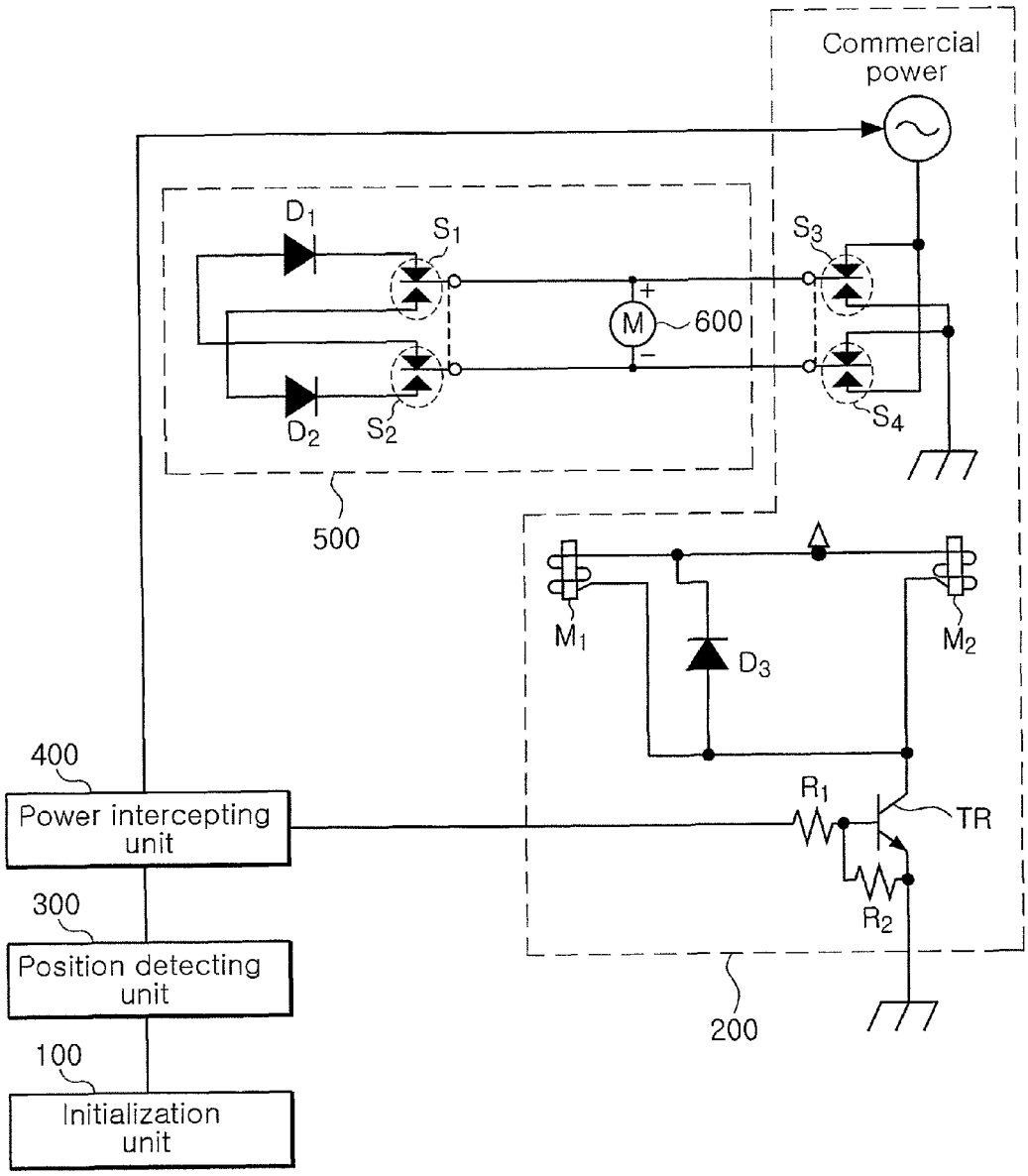
FIG. 2 is a schematic block diagram of an apparatus for controlling a bedpan seat and a bedpan seat cover using a counter electromotive force of a motor according to an exemplary embodiment of the present invention.

FIG. 2 is a schematic block diagram of an apparatus for controlling a bedpan seat and a bedpan seat cover using a counter electromotive force of a motor according to an exemplary embodiment of the present invention. As shown in FIG. 2, the apparatus for controlling a bedpan seat and a bedpan seat cover using a counter electromotive force of a motor includes an initialization unit 100, a motor driving unit 200, a position detecting unit 300, a power intercepting unit 400, and a counter electromotive force generating unit 500.

When the bedpan seat or the bedpan seat cover in a closed state is open to stop at a pre-set angle, the initialization unit 100 receives a stop signal from the position detecting unit 300 to recognize the position of the bedpan seat and or bedpan seat cover as an initial state. The pre-set angle of the bedpan seat or the bedpan seat cover must be set as 90° or larger to make the bedpan seat or the bedpan seat cover maintained in the stop state.

The motor driving unit 200 drives an electric damper (not shown) by driving the motor 600 to operate the bedpan seat or the bedpan seat cover (not shown). The operation of opening the bedpan seat or the bedpan seat cover in a closed state is performed by driving the motor 600 upon receiving commercial power in an OFF state of relay switches S3 and S4, and the operation of closing the bedpan seat or the bedpan seat cover in a completely open state is performed by driving the motor 600 upon receiving commercial power in an ON state of the relay switches S3 and S4. During the closing operation of the bedpan seat or the bedpan seat cover, current flows to resistors R1 and R2, and a transistor TR operates to excite magnets M1 and M2 to make current flow to a diode D3. The relay switches S1, S2, S3, and S4 are turned on according to the excitation of the magnets M1 and M2.

The position detecting unit 300 detects the position of the bedpan seat or the bedpan seat cover operated by the motor driving unit 200. In order to detect the position, the position detecting unit 300 counts a time duration during which the bedpan seat or the bedpan seat cover operates in an initial state. Namely, the position detecting unit 300 counts the number of pulse signals outputted from the motor driving unit 200 starting from a point when the bedpan seat or the bedpan seat cover starts to operate in the initial state, to thus count the time duration during which the bedpan seat or the bedpan seat cover operates in the initial state.

The power intercepting unit 400 receives a signal of detecting the position of the bedpan seat or the bedpan seat cover from position detecting unit 300, and if it determines that the bedpan seat or the bedpan seat cover is placed at a pre-set position based on the received position detect signal, the power intercepting unit 400 cuts off power. When the power intercepting unit 400 cuts off power, the pre-set position of the bedpan seat or the bedpan seat cover may be at one of angles ranging from 40° to 50° after the bedpan seat or the bedpan seat cover in the closed state is open and stopped.

When the power intercepting unit 400 cuts off power, the counter electromotive force generating unit 500 generates a counter electromotive force of the motor 600. When power is cut off while the bedpan seat or the bedpan seat cover is being closed, current flows through a diode D1 in an ON state of the switches S1 and S2 and the motor 600, generating the counter electromotive force, operates as a generator.

Figure 3:
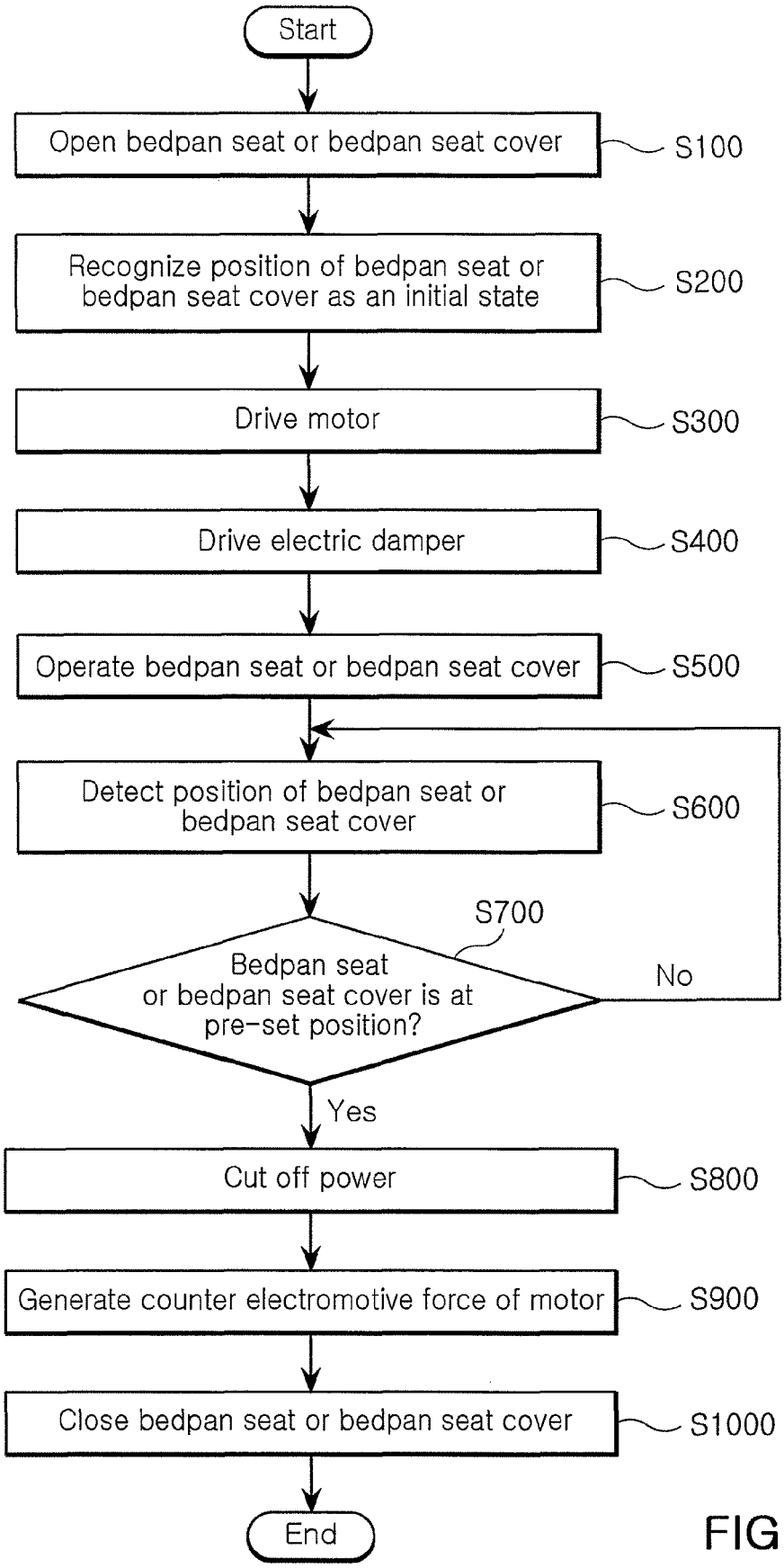
FIG. 3 is a flow chart illustrating a method for controlling the bedpan seat and the bedpan seat cover using a counter electromotive force of a motor according to an exemplary embodiment of the present invention.

FIG. 3 is a flow chart illustrating a method for controlling the bedpan seat and the bedpan seat cover using the counter electromotive force of the motor according to an exemplary embodiment of the present invention. With reference to FIGS.

2 and 3, in steps S100 and S200, the bedpan seat or the bedpan seat cover in a state of closing the toilet pot are open, and in step S300 to S1000, the bedpan seat or the bedpan seat cover in a completely open state are closed. The operations that the bedpan seat or the bedpan seat cover in the state of closing the toilet pot are completely open and close again the toilet pot are as follows.

First, the motor driving unit 200 drives the electric damper by driving the motor 600 to operate the bedpan seat or the bedpan seat cover to be completely open from the toilet pot (S100).

The initialization unit 100 recognizes the position of the bedpan seat or the bedpan seat cover as an initial state (S200). When the bedpan seat or the bedpan seat cover in the closed state is open at a pre-set angle or larger and stops, the initialization unit 100 receives a stop signal from the position detecting unit 300 to recognize that the bedpan seat or the bedpan seat cover is in the initial state.

Subsequently, the motor driving unit 200 drives the electric damper by driving the motor 600 to operate the bedpan seat or the bedpan seat cover (S300, S400, S500).

And then, the position detecting unit 300 detects the position of the bedpan seat or the bedpan seat cover operated by the motor driving unit 200 (S600).

Thereafter, the power intercepting unit 400 receives a signal of detecting the position of the bedpan seat or the bedpan seat cover from the position detecting unit 300, and determines whether or not the bedpan seat or the bedpan seat cover is at the pre-set position based on the received position detect signal (S700).

If the power intercepting unit 400 determines that the bedpan seat or the bedpan seat cover is at the pre-set position, it cuts off power (S800). If, however, the power intercepting unit 400 determines that the bedpan seat or the bedpan seat cover is not at the pre-set position, it repeats determining of the position of the bedpan seat or the bedpan seat cover until when the bedpan seat or the bedpan seat cover is at the pre-set position.

When the power intercepting unit 400 cuts off power, the counter electromotive force generating unit 500 generates a counter electromotive force of the motor 600 (S900) to allow the bedpan seat or the bedpan seat cover to be more slowly closed than it is closed by gravity (S1000).

Figure 4:
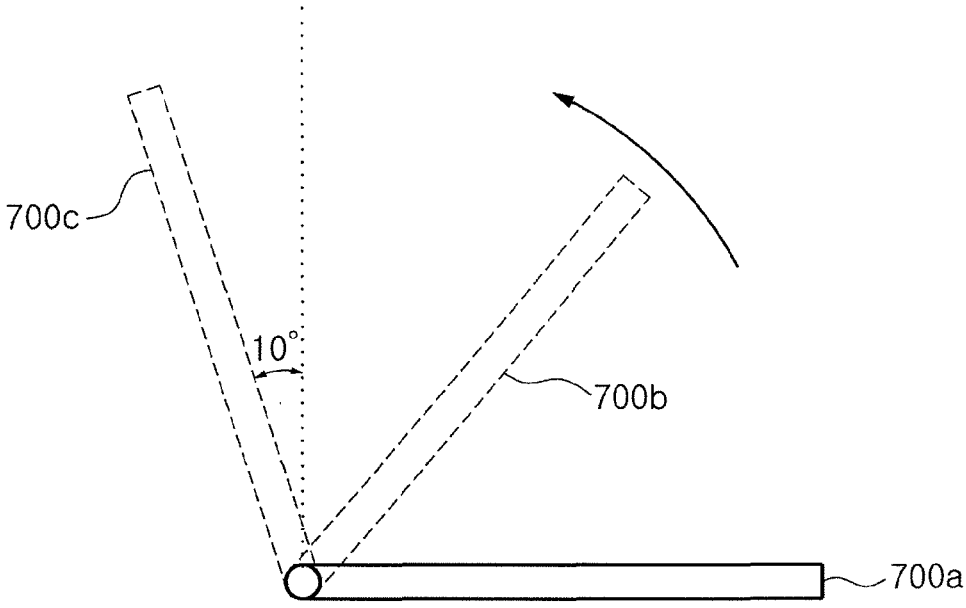
FIG. 4 is a schematic view illustrating an opening operation of a bedpan seat according to an exemplary embodiment of the present invention.

FIG. 4 is a schematic view illustrating an opening operation of a bedpan seat according to an exemplary embodiment of the present invention. As shown in FIG. 4, when the bedpan seat in a state of closing the toilet pot is open by driving the electric damper according to driving of the motor 600, the positions of the bedpan seat change in the order of 700*a*, 700*b*, and 700*c*.

When the bedpan seat is completely open, it is slightly sloped in a vertical direction so as to be stably stopped. In an embodiment of the present invention, the sloped angle in the vertical direction is set as 10°.

Figure 5:
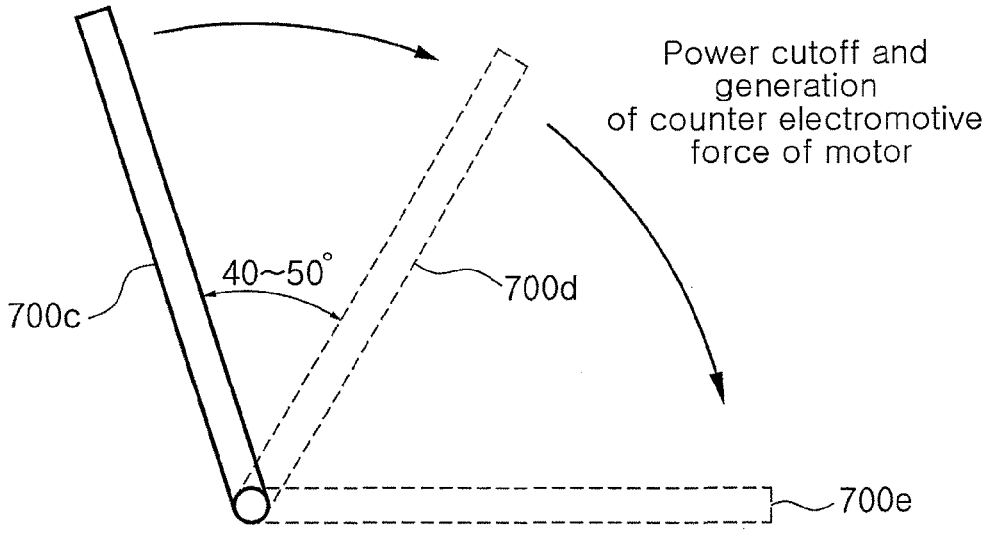
FIG. 5 is a schematic view illustrating a closing operation of a bedpan seat according to an exemplary embodiment of the present invention.

FIG. 5 is a schematic view illustrating a closing operation of a bedpan seat according to an exemplary embodiment of the present invention. As shown in FIG. 5, when the bedpan seat in the completely open state is closed by the electric damper according to driving of the motor 600, the positions of the bedpan seat change in the order of 700*c*, 700*d*, and 700*e*.

When the bedpan seat is closed at a pre-set angle (e.g., 40° to 50°), power is cut off, so the motor 600, generating the counter electromotive force, is operated as a generator. In this case, the motor 600 operates the bedpan seat in the direction opposite to the direction in which the bedpan seat was operated. Although the bedpan seat is closed by gravity, because the counter electromotive force is generated from the motor 600 in the direction opposite to the direction in which the bedpan seat is closed, the bedpan seat is closed at a lower speed than that by gravity. Thus, an impact sound that may be generated when the bedpan seat collides with the toilet pot can be reduced.

Therefore, old or feeble persons, children, pregnant women and nursing mothers, and so on, would not be frightened by the impact sound, and the opening and closing unit (i.e., the bedpan seat or the bedpan seat cover) can be favorably used in a place where quite atmosphere needs to be maintained.

The opening and closing operation of the bedpan seat as described with reference to FIGS. 4 and 5 may be also applicable to the bedpan seat cover, and the same principle is applied when the bedpan seat and the bedpan seat cover are simultaneously open and closed.

While the present invention has been shown and described in connection with the exemplary embodiments, it will be apparent to those skilled in the art that modifications and variations can be made without departing from the spirit and scope of the invention as defined by the appended claims.

The invention claimed is:

1. An apparatus for controlling a rotational movement of an opening and closing unit by using a counter electromotive force of a motor, the apparatus comprising:

a motor driving unit that drives an electric damper by driving a motor to operate the opening and closing unit;

a position detecting unit that detects the position of the opening and closing unit operated by the motor driving unit;

a power intercepting unit that receives a signal of detecting the position of the opening and closing unit from the position detecting unit, and cuts off power if it determines that the opening and closing unit is at a pre-set position based on the received position detect signal; and a counter electromotive force generating unit that generates a counter electromotive force of the motor when the power intercepting unit cuts off power.

2. The apparatus of claim 1, wherein the opening and closing unit comprises a bedpan seat or a bedpan seat cover provided at a toilet stool.

3. The apparatus of claim 2, further comprising:

an initialization unit that recognizes the position of the bedpan seat or the bedpan seat cover as an initial state upon receiving a stop signal from the position detecting unit, when the bedpan seat or the bedpan seat cover in a closed state is open and then stopped at a pre-set angle or larger.

4. The apparatus of claim 2, wherein the position detecting unit detects the position of the bedpan seat or the bedpan seat cover by counting time during which the bedpan seat or the bedpan seat cover has operated at its initial state.

5. The apparatus of claim 4, wherein the position detecting unit detects the position of the bedpan seat or the bedpan seat cover by counting the number of pulse signals outputted from the motor driving unit from a point when the bedpan seat or the bedpan seat cover starts to operate at the initial state.

6. The apparatus of claim 2, wherein when the power intercepting unit cuts off power, the pre-set position of the bedpan seat or the bedpan seat cover is a position at one of angles ranging from 40° to 50° after the bedpan seat or the bedpan seat cover is open and then stopped at the pre-set angle or larger from its closed state.

7. A method for controlling a rotational movement of an opening and closing unit by using a counter electromotive force of a motor, the method comprising:

driving, by a motor driving unit, an electric damper by driving a motor to operate the opening and closing unit;

detecting, by a position detecting unit, the position of the opening and closing unit operated by the motor driving unit;

receiving, by a power intercepting unit, a signal of detecting the position of the opening and closing unit from the position detecting unit, and cutting off power if it determines that the opening and closing unit is placed at a pre-set position based on the received position detect signal; and generating, by a counter electromotive force generating unit, a counter electromotive force of the motor when the power intercepting unit cuts off power.

8. The method of claim 7, further comprising:

recognizing, by an initialization unit, the position of the bedpan seat or the bedpan seat cover as the opening and closing unit provided at the toilet stool, as an initial state upon receiving a stop signal from the position detecting unit, when the bedpan seat or the bedpan seat cover in a closed state is open and then stopped at a pre-set angle or larger.

* * * * *